US010795284B2

(12) United States Patent
Suenaga

(10) Patent No.: US 10,795,284 B2
(45) Date of Patent: Oct. 6, 2020

(54) DEVELOPER STORAGE CONTAINER

(71) Applicant: Konica Minolta, Inc., Tokyo (JP)

(72) Inventor: Takenori Suenaga, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/695,382

(22) Filed: Nov. 26, 2019

(65) Prior Publication Data

US 2020/0174398 A1 Jun. 4, 2020

(30) Foreign Application Priority Data

Nov. 29, 2018 (JP) ..... 2018-223094

(51) Int. Cl.
*G03G 15/08* (2006.01)

(52) U.S. Cl.
CPC ..... *G03G 15/0872* (2013.01); *G03G 15/087* (2013.01); *G03G 15/0867* (2013.01); *G03G 15/0877* (2013.01); *G03G 2215/0663* (2013.01); *G03G 2215/0665* (2013.01); *G03G 2215/0668* (2013.01); *G03G 2215/0678* (2013.01)

(58) Field of Classification Search
CPC ..... G03G 15/0867; G03G 15/087; G03G 15/0872; G03G 15/0877; G03G 2215/0663; G03G 2215/0665; G03G 2215/0668; G03G 2215/0678
See application file for complete search history.

(56) References Cited

U.S. PATENT DOCUMENTS 6,259,877 B1 * 7/2001 Taniyama ..... G03G 15/0872 222/DIG. 1
2009/0279916 A1 * 11/2009 Naito ..... G03G 15/0872 399/106
2016/0378021 A1 * 12/2016 Yamane ..... G03G 15/0865 399/262

FOREIGN PATENT DOCUMENTS

JP 2001272852 A 10/2001
JP 2001272853 A 10/2001
JP 2015045815 A 3/2015

* cited by examiner

*Primary Examiner* — Joseph S Wong
(74) *Attorney, Agent, or Firm* — Cantor Colburn LLP

(57) ABSTRACT

A developer storage container includes a container body, and a discharge member, wherein the container body includes a first opening on a downstream side in a conveyance direction in which the developer is conveyed, and includes a first side wall, the first side wall includes on an inner surface a protrusion, the discharge member is provided at the first opening to close the first opening, and includes a discharge port, and includes a suppressor, and includes a second side wall, the suppressor includes a plurality of scooping-up members, each of the plurality of scooping-up members includes a scooping-up surface, and a plurality of second openings connecting to the space is provided on the scooping-up surface of any of the plurality of scooping-up members at respective positions different from each other in the conveyance direction.

7 Claims, 20 Drawing Sheets

DEVELOPER STORAGE CONTAINER

CROSS REFERENCE TO RELATED APPLICATIONS

The present invention claims priority under 35 U.S.C. § 119 to Japanese patent Application No. 2018-223094, filed on Nov. 29, 2018, is incorporated herein by reference in its entirety.

BACKGROUND

Technological Field

The present invention relates to a developer storage container used in an electrophotographic image forming apparatus.

Description of the Related Art

An electrophotographic image forming apparatus forms a toner image on a photoreceptor, an intermediate transfer belt, or the like, and transfers the formed toner image to a sheet by a transfer unit. Then, the transferred toner image is fixed on the sheet by a fixing unit.

In addition, in the image forming apparatus, a developer storage container is mounted for supplying a developer to a developing unit. The developer storage container stores a developer in which a toner and a carrier are combined. In many cases, a developer storage container is used in which the container body is arranged sideways with respect to the image forming apparatus. Note that, the developer storage container is sometimes called a "toner bottle".

A spiral protrusion is provided on the inner circumferential surface of the container body to convey the stored developer. Then, the container body is rotated, whereby the stored developer is conveyed to a discharge port provided at the tip of the container body and discharged to the developing unit.

As the amount of developer stored in the container body increases, the amount of developer conveyed to the discharge port tends to be larger than the amount of developer discharged from the discharge port. Then, the density of the developer increases in a space near the discharge port, and the fluidity of the developer tends to be reduced. It therefore becomes difficult for the developer to be discharged from the discharge port.

Thus, a developer storage container has been devised described in JP 2015-45815 A. The developer storage container includes a container body, a discharge member, and a regulating member. The regulating member is arranged in a space formed by the container body and the discharge member, and partitions the space into a storage space in which the developer is stored in the container body and a discharge side space in which the developer to be discharged from the discharge port is stored. Further, the regulating member forms a passage hole through which the developer passes, and regulates the amount of the developer conveyed from the storage space to the discharge side space.

The toner storage container described in JP 2001-272852 A or JP 2001-272853 A has a cylindrical form including a toner discharge port at one end, and includes a spiral groove protruding on the inner circumferential surface and recessed on the outer circumferential surface of the cylindrical form, and the number of threads per circumference of the spiral groove increases toward the toner discharge port. A scooping-up mechanism is provided inside the toner storage container described in JP 2001-272853 A.

By the way, according to the developer storage container or toner storage container described in JP 2015-45815 A, JP 2001-272852 A, and JP 2001-272853 A, if the developer has a certain range of fluidity, the container can suppress that a developer is agglomerated near the discharge port, and can prevent that it becomes difficult for the developer to come out from the discharge port.

However, if the developer is one in which toners different in fluidity are combined, it may become difficult for the developer to come out from the discharge port.

SUMMARY

In view of such a problem, the present invention has an object to reduce, compared to conventional developer storage containers, that a developer having a certain fluidity is agglomerated near the discharge port when the developer is discharged from the developer storage container.

To achieve the abovementioned object, according to an aspect of the present invention, a developer storage container reflecting one aspect of the present invention comprises a container body that stores a developer, and a discharge member that suppresses an amount of the developer to be discharged from the container body, wherein the container body includes a first opening on a downstream side in a conveyance direction in which the developer is conveyed, and includes a first side wall whose cross section perpendicular to the conveyance direction is round, the first side wall includes on an inner surface a protrusion that continuously or intermittently continues to the downstream side spirally in a specific winding direction, the discharge member is provided at the first opening to close the first opening, and includes a discharge port that discharges the developer on the downstream side, and includes a suppressor that closes a space connecting to the discharge port on an upstream side in the conveyance direction from the discharge port, and includes a second side wall that is continuous to surround the suppressor along the conveyance direction, the suppressor includes a plurality of scooping-up members, each of the plurality of scooping-up members includes a scooping-up surface that scoops up the developer, and a plurality of second openings connecting to the space is provided on the scooping-up surface of any of the plurality of scooping-up members at respective positions different from each other in the conveyance direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
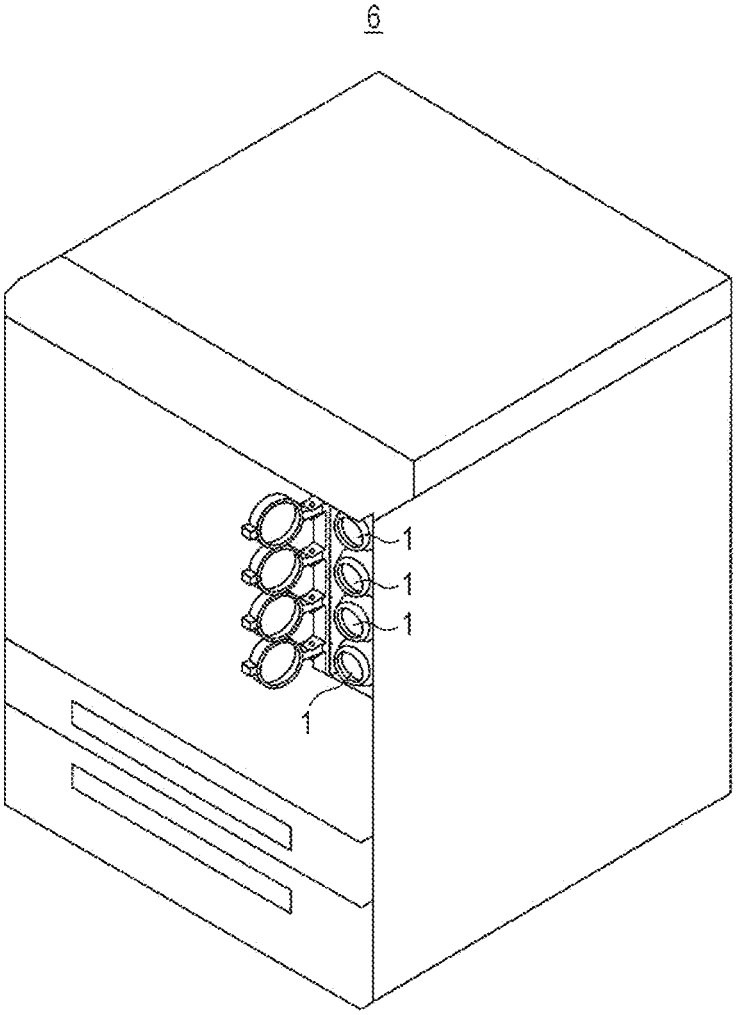
FIG. 1 is a diagram illustrating an example of appearance of an image forming apparatus.
Figure 2:
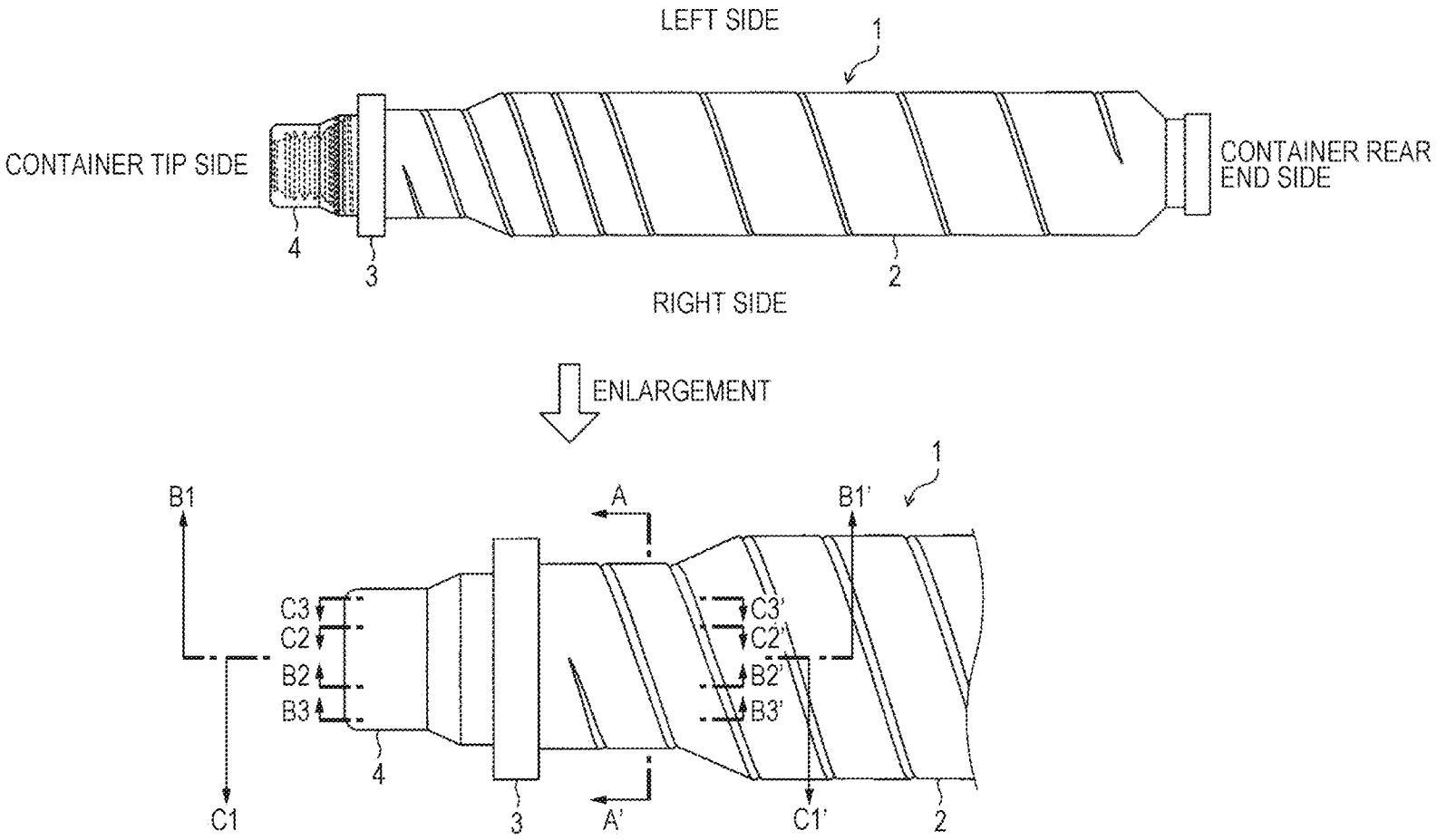
FIG. 2 is a diagram illustrating an example of a developer storage container as viewed from above.

FIG. 1 is a diagram illustrating an example of appearance of an image forming apparatus 6. FIG. 2 is a diagram illustrating an example of a developer storage container 1 as viewed from above.

The image forming apparatus 6 illustrated in FIG. 1 is an electrophotographic image forming apparatus such as a multifunction machine, a copying machine, a printer, or a facsimile terminal, and prints an image on a sheet by using toner. The toner is supplied together with a carrier and the like from the developer storage container 1 as illustrated in FIG. 2. Hereinafter, a mixture of the toner and the carrier and the like is referred to as "developer".

In a case where the image forming apparatus 6 is an apparatus that prints an image on a sheet by using toners of four colors of cyan, magenta, yellow, and black, that is, in a case where it is a so-called color machine, the developer storage containers 1 are mounted for the respective four colors in the image forming apparatus 6, and the developers for the respective four colors are supplied from the corresponding developer storage containers 1.

The developer storage container 1 is mounted on the image forming apparatus 6 in a state where the developer storage container 1 is laid down so that the longitudinal direction of the developer storage container 1 is substantially horizontal. Then, the developer storage container 1 supplies the developer to the image forming apparatus 6 while rotating around a rotation axis L.

Configurations are common of all of the developer storage containers 1 of cyan, magenta, yellow, and black. Thus, hereinafter, taking a developer storage container 1 of a specific one color as an example, the configuration, function, and the like will be described below of the developer storage container 1.

[Configuration of Developer Storage Container 1]

Figure 3:
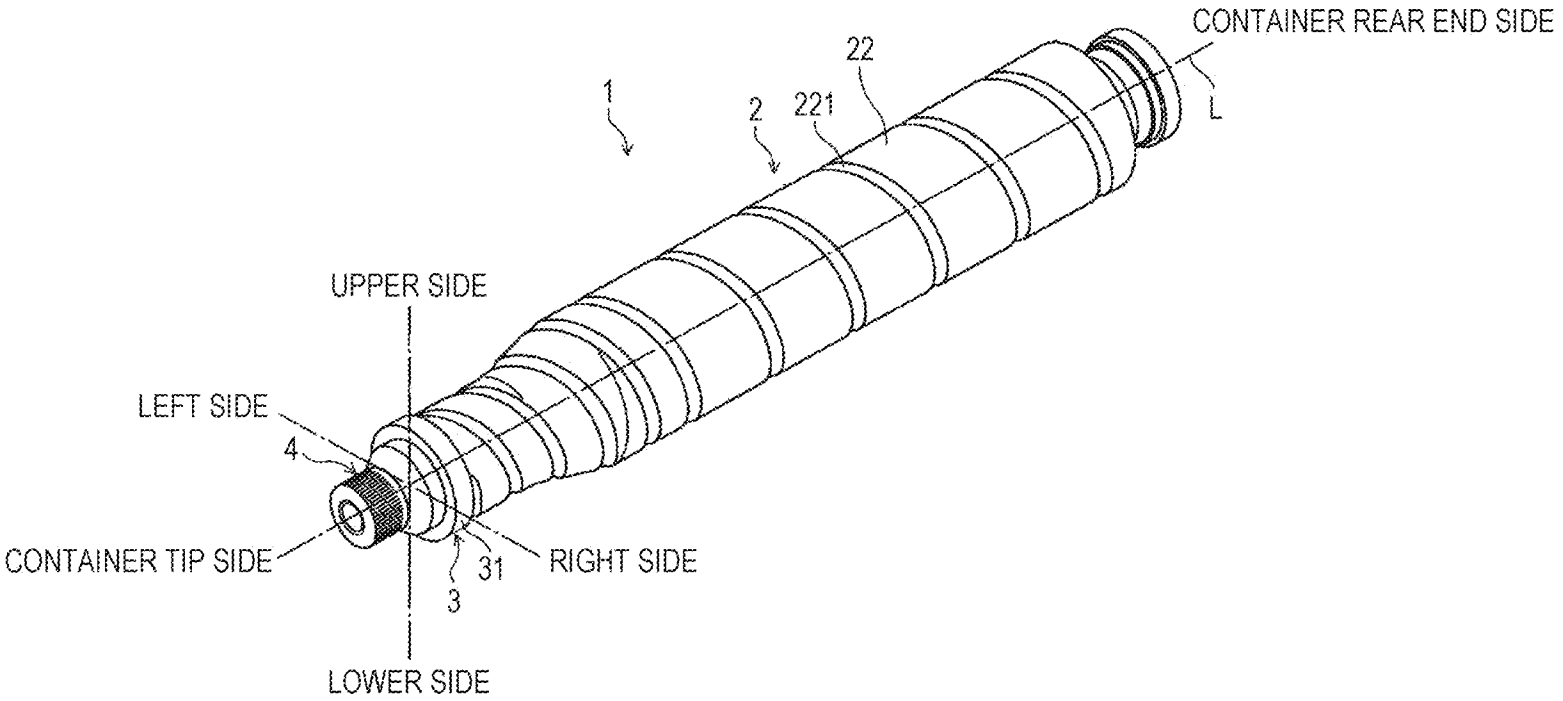
FIG. 3 is a perspective view illustrating an example of appearance of the developer storage container.
Figure 4:
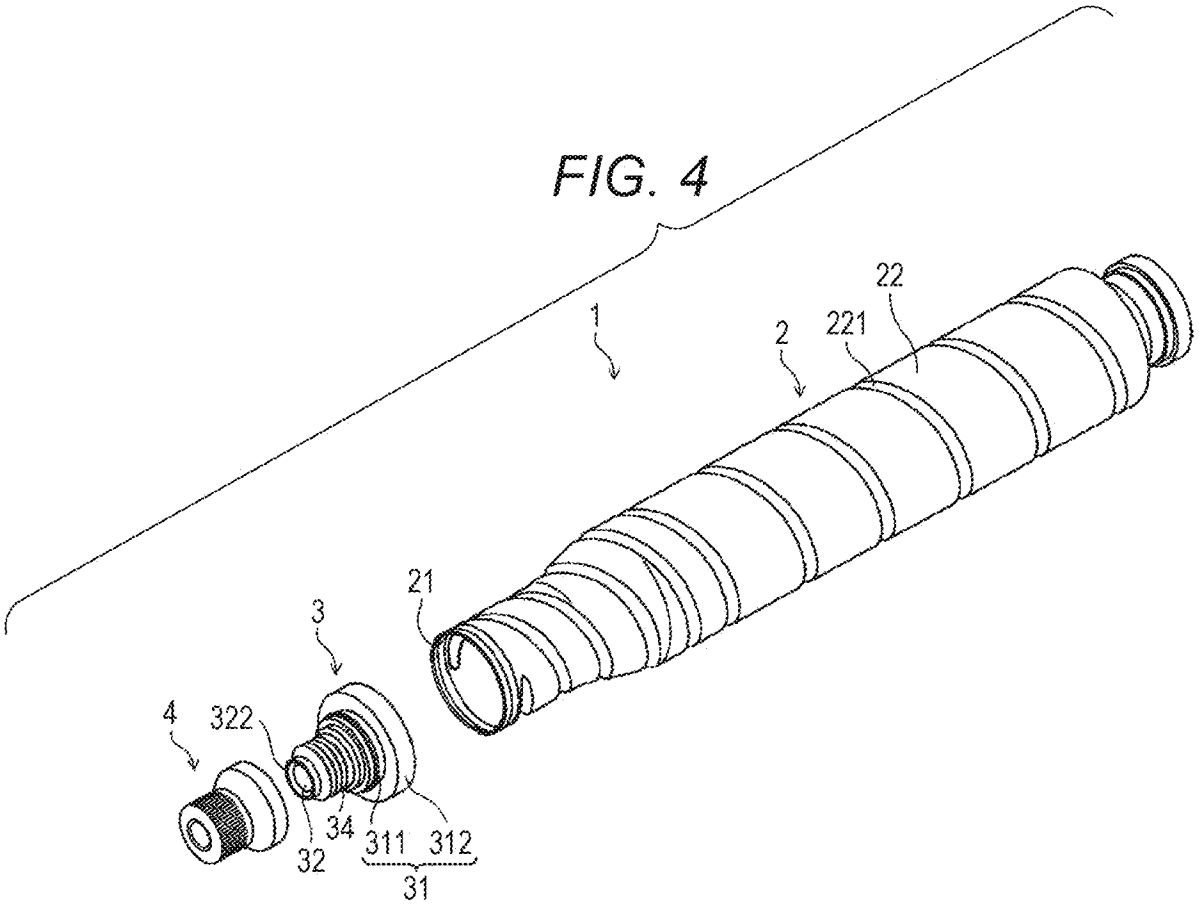
FIG. 4 is a diagram illustrating an example of a state in which the developer storage container is disassembled.

FIG. 3 is a perspective view illustrating an example of appearance of the developer storage container 1. FIG. 4 is a diagram illustrating an example of a state in which the developer storage container 1 is disassembled.

As illustrated in FIG. 3 or FIG. 4, the developer storage container 1 includes a container body 2, a discharge member 3, a cap 4, and the like. Hereinafter, in the developer storage container 1, an end on which the cap 4 is provided is referred to as "container tip", and an opposite end of the container tip is referred to as "container rear end".

The discharge member 3 is attached to the container tip side of the container body 2. The cap 4 is attached to the container tip side of the discharge member 3.

[Container Body 2]

The container body 2 stores a developer. The container body 2 is formed in a hollow substantially cylindrical shape, and is provided with an opening 21 on the container tip side.

On a side wall 22 of the container body 2, a protrusion 221 that protrudes toward the inside of the container body 2 is spirally formed continuously or intermittently. The protrusion 221 is formed from the end on the container rear end side to the end on the container tip side. Note that, a direction (direction of winding) of the spiral of the protrusion 221 is set to correspond to a rotation direction of the container body 2.

In this example, the protrusion 221 is doubly provided in the vicinity of the container tip of the container body 2, but may be single, or may be triple or more.

The radius of a cross section cut perpendicularly to the longitudinal direction of the container body 2 maintains a constant radius in a portion up to a certain distance from the opening 21 toward the container rear end side. Further from there, in a portion up to a certain distance, the radius of the cross section gradually increases. Then, in a remaining portion up to the container rear end, the radius of the cross section maintains a constant radius.

The container body 2 rotates around the rotation axis L, whereby the protrusion 221 conveys the developer stored in the container body 2 to the opening 21.

[Discharge Member 3]

Figure 5A:
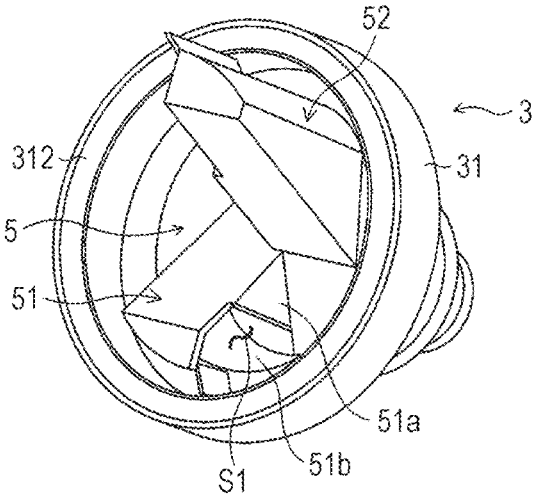
FIG. 5A and FIG. 5B are perspective views each illustrating an example of appearance of a discharge member as viewed from the container rear end side.
Figure 5B:
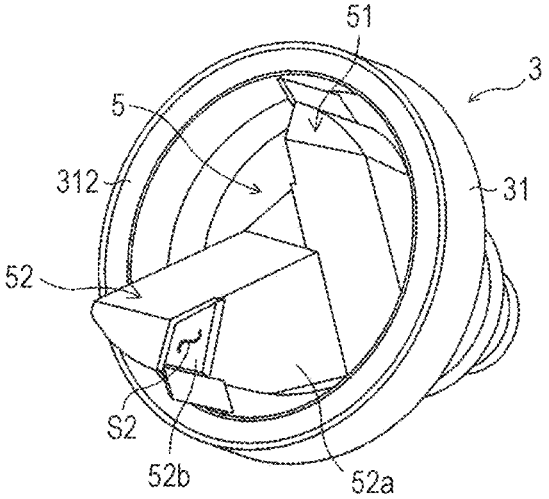
Figure 6:
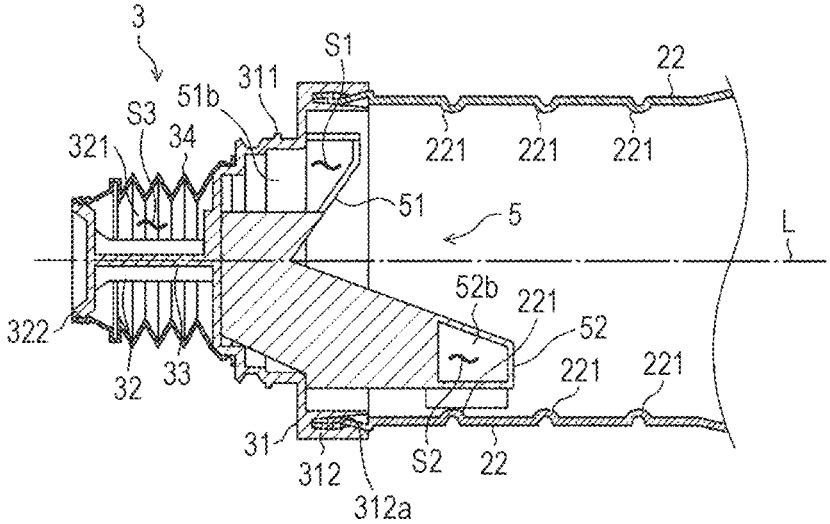
FIG. 6 is a cross-sectional view illustrating a state cut along a line B1-B1' of FIG. 2 of the example.
Figure 7:
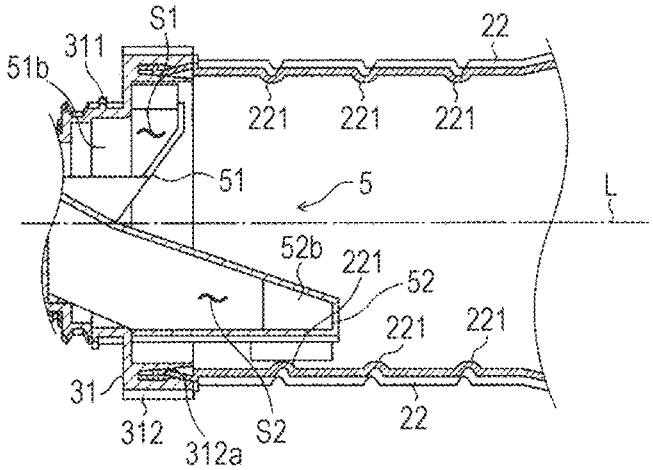
FIG. 7 is a cross-sectional view illustrating a state cut along a line B2-B2' of FIG. 2 of the example.
Figure 8:
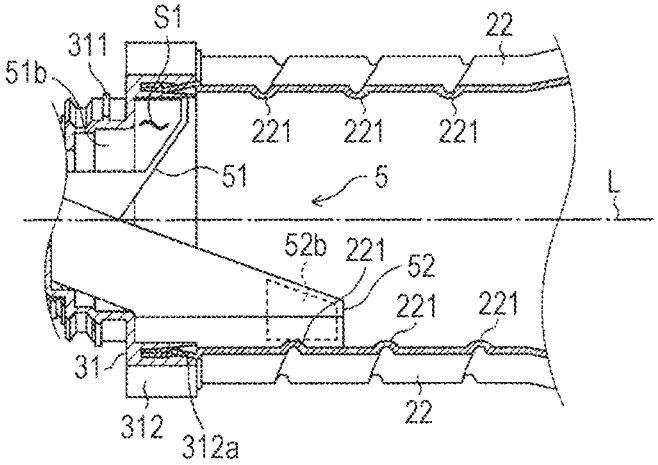
FIG. 8 is a cross-sectional view illustrating a state cut along a line B3-B3' of FIG. 2 of the example.
Figure 9:
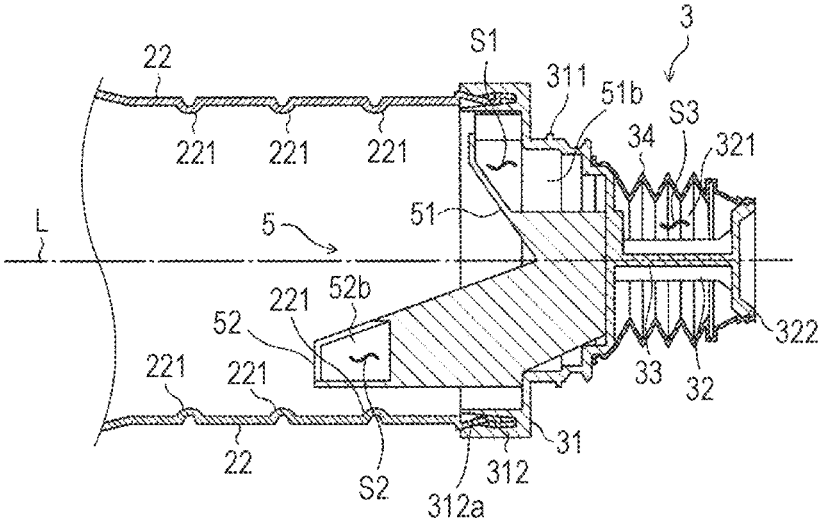
FIG. 9 is a cross-sectional view illustrating a state cut along a line C1-C1' of FIG. 2 of the example.
Figure 10:
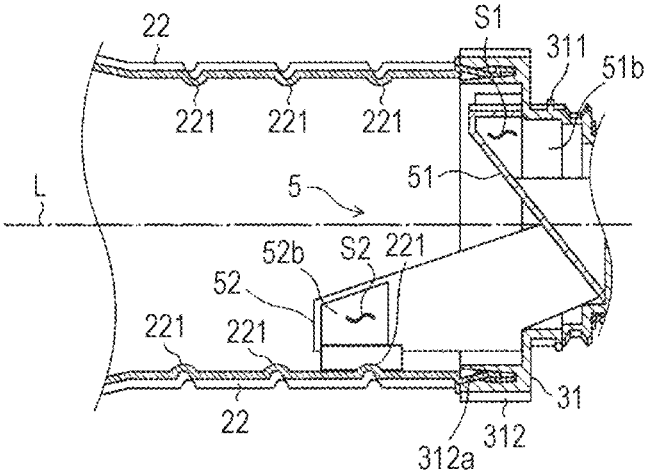
FIG. 10 is a cross-sectional view illustrating a state cut along a line C2-C2' of FIG. 2 of the example.
Figure 11:
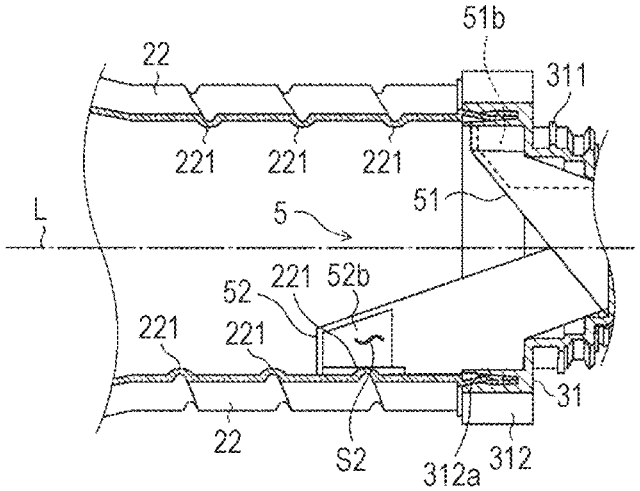
FIG. 11 is a cross-sectional view illustrating a state cut along a line C3-C3' of FIG. 2 of the example.
Figure 12:
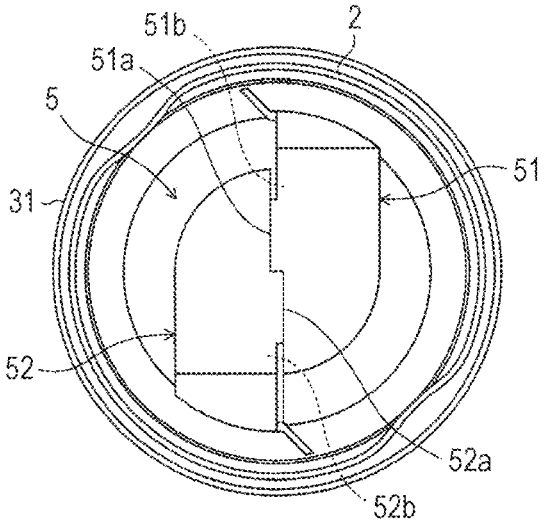
FIG. 12 is a cross-sectional view illustrating a state cut along a line A-A' of FIG. 2 of the example.

FIG. 5A and FIG. 5B are perspective views each illustrating an example of appearance of the discharge member 3 as viewed from the container rear end side. FIG. 6 is a cross-sectional view illustrating a state cut along a line B1-B1' of FIG. 2 of the example. FIG. 7 is a cross-sectional view illustrating a state cut along a line B2-B2' of FIG. 2 of the example. FIG. 8 is a cross-sectional view illustrating a state cut along a line B3-B3' of FIG. 2 of the example. FIG. 9 is a cross-sectional view illustrating a state cut along a line C1-C1' of FIG. 2 of the example. FIG. 10 is a cross-sectional view illustrating a state cut along a line C2-C2' of FIG. 2 of the example. FIG. 11 is a cross-sectional view illustrating a state cut along a line C3-C3' of FIG. 2 of the example. FIG. 12 is a cross-sectional view illustrating a state cut along a line A-A' of FIG. 2 of the example.

The discharge member 3 is attached to the container body 2 to close the opening 21 of the container body 2. As illustrated in FIG. 5A to FIG. 12, the discharge member 3 includes a mouth portion 31, a discharge portion 32, a covering portion 34, a scooping-up portion 5, and the like.

The mouth portion 31 has a shape in which two cylinders, in which the radius on one of the cylinders on the container tip side is shorter than that of the other on the container rear end side, are stacked so that their centers coincide with each other. The mouth portion 31 includes a threaded portion 311 on the side surface of the cylinder on the container tip side, and includes a locking portion 312 on the side surface of the cylinder on the container rear end side.

The threaded portion 311 is screwed with a thread groove provided inside the cap 4. Inside the locking portion 312, a locking groove 312*a* is provided formed from the rear end of the mouth portion 31 toward the container tip side. The tip of the container body 2 is inserted into the locking groove 312*a*. Then, the locking portion 312 locks with the tip of the container body 2. As a result, the discharge member 3 rotates integrally with the container body 2. In addition, the discharge portion 32 is provided at the tip of the mouth portion 31.

The discharge portion 32 includes a discharge port 321, a hooking portion 322, and a connecting portion 323. The discharge port 321 is an outlet for discharging the developer out of the developer storage container 1.

The hooking portion 322 is formed in a substantially disc shape. The tip of the covering portion 34 described later is temporarily hooked to the hooking portion 322. The hooking portion 322 is provided with the connecting portion 323. The connecting portion 323 connects the hooking portion 322, the rear end of the covering portion 34, and the scooping-up portion 5 described later together.

The covering portion 34 is formed as a substantially cylindrical bellows-shaped member. The tip of the covering portion 34 is hooked and fastened at the hooking portion 322 of the discharge portion 32. The rear end of the covering portion 34 is fixed to the tip of the mouth portion 31. Hereinafter, a space inside the covering portion 34 is referred to as "space S3".

The scooping-up portion 5 limits the amount of the developer passing through the opening 21 while promoting the flow of the developer by scooping up the developer. The scooping-up portion 5 is formed inside the discharge member 3 integrally with the discharge member 3. In addition, the scooping-up portion 5 includes a first scooping-up member 51 and a second scooping-up member 52.

As illustrated in FIG. 5A to FIG. 8, the first scooping-up member 51 is a hollow member having a shape like a triangular prism, and is arranged in a section approximately from the end on the container rear end side of the covering portion 34 to the end on the container rear end side of the mouth portion 31. In addition, an opening 51*b* is provided at a position close to the side wall 22 of a facing wall 51*a* facing the second scooping-up member 52.

Similarly to the first scooping-up member 51, the second scooping-up member 52 is also a hollow member having a shape like a triangular prism. In addition, an opening 52*b* is provided at a position close to the side wall 22 of the facing wall 52*a* facing the first scooping-up member 51. The facing wall 51*a* and the facing wall 52*a* are parallel to the rotation axis L. Note that, the angle with the rotation axis L may be several degrees.

However, the length in the rotation axis L direction is longer in the second scooping-up member 52 than in the first scooping-up member 51, and the opening 52*b* is arranged on the container rear end side from the facing wall 51*a*.

Hereinafter, a space in the first scooping-up member 51 and a space in the second scooping-up member 52 are referred to as "space S1" and "space S2," respectively. The space S1 and the space S2 are both connected to the space S3.

In a state before the developer storage container 1 is mounted on the image forming apparatus 6, the covering portion 34 covers the discharge port 321 of the discharge portion 32. As a result, the developer can be prevented from leaking out of the discharge port 321 before the developer storage container 1 is mounted to the image forming apparatus 6. In addition, when the developer storage container 1 is mounted to the image forming apparatus 6, the tip of the covering portion 34 is detached from the hooking portion 322 and is shrunk toward the container rear end side. As a result, the discharge port 321 of the discharge portion 32 is exposed.

[Cap 4]

The cap 4 is formed in a hollow substantially truncated cone shape as illustrated in FIG. 4. The inner wall of the cap 4 is provided with a thread groove screwed with the threaded portion 311 of the mouth portion 31. Before the developer storage container 1 is mounted to the image forming apparatus 6, the cap 4 is attached to the discharge member 3 to cover the covering portion 34 as illustrated in FIG. 3. Then, in mounting, the cap 4 is removed from the discharge member 3.

[Developer Discharge Operation]

Next, developer discharge operation will be described in the developer storage container 1.

The container body 2 is filled with a developer in advance. Then, the cap 4 is removed and the developer storage container 1 is mounted to the image forming apparatus 6. At this time, the tip of the covering portion 34 is detached from the hooking portion 322 in conjunction with mounting, and is shrunk toward the rear end, and the discharge port 321 of the discharge portion 32 is exposed.

When the container body 2 rotates around the rotation axis L, the discharge member 3 also rotates integrally with the container body 2. Then, the developer is conveyed from the container body 2 to the discharge member 3 little by little by the protrusion 221 as follows.

When the developer is conveyed to the vicinity of the scooping-up portion 5 of the discharge member 3, the developer is scooped up by the facing wall 51*a* of the first scooping-up member 51 and the facing wall 52*a* of the second scooping-up member 52. If there are not the opening 51*b* nor the opening 52*b*, the developer is stopped by the scooping-up portion 5, and is not conveyed further to the container tip side.

However, since there are the opening 51*b* and the opening 52*b*, a part of the developer enters the space S1 or the space S2 from the opening 51*b* or the opening 52*b*. Then, the developer is conveyed to the space S3 and discharged out of the developer storage container 1 from the discharge port 321.

According to the present embodiment, the position of the opening 51*b* and the position of the opening 52*b* are shifted from each other in the developer conveyance direction. As a result, it can be reduced, compared to conventional developer storage containers, that a developer having a certain fluidity is agglomerated near the discharge port when the developer is discharged from the developer storage container 1. As a result, occurrence can be suppressed more reliably of decrease in the density of the image generated due to the defective discharge of the developer or generation of agglomerates, compared to conventional developer storage containers.

Modifications

In the present embodiment, two scooping-up members (the first scooping-up member 51 and the second scooping-up member 52) are provided on the scooping-up portion 5; however, three or more scooping-up members may be provided.

A blade or a spiral guide for conveying the developer may be provided on the support shaft portion 33. As a result, even when the amount of developer decreases, the developer can be efficiently discharged from the discharge port 321.

Figure 13A:
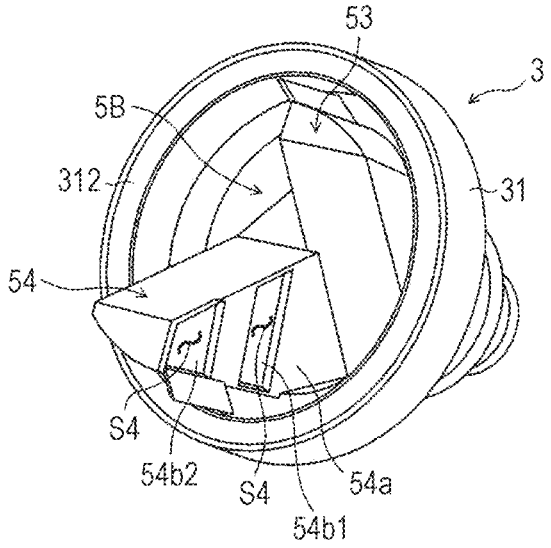
FIG. 13A and FIG. 13B are perspective views each illustrating a modification of the appearance of the discharge member as viewed from the container rear end side.
Figure 13B:
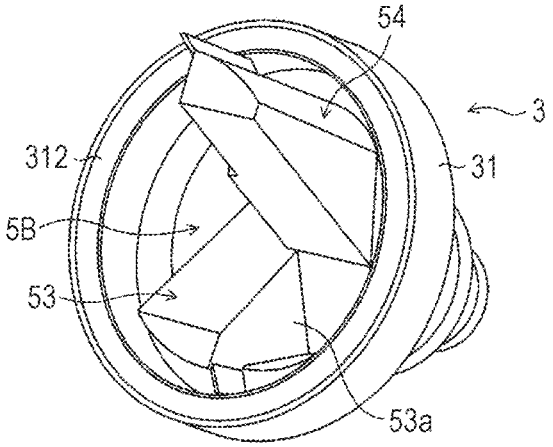
Figure 14:
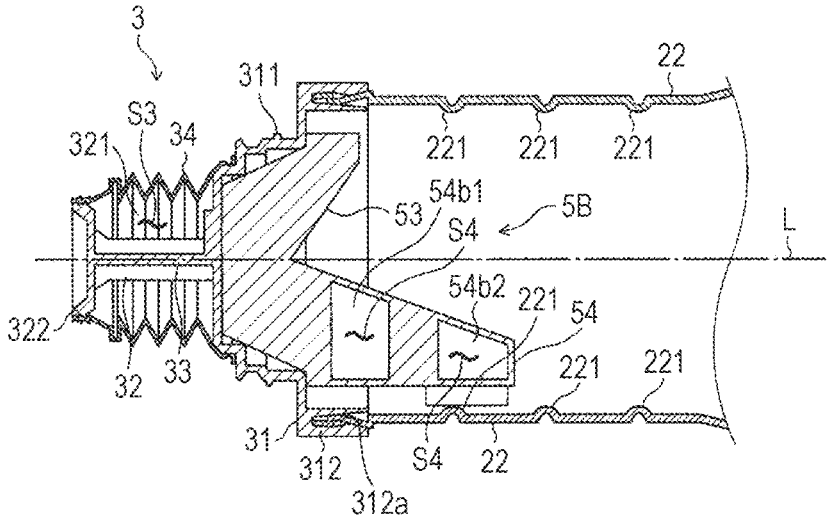
FIG. 14 is a cross-sectional view illustrating the state cut along the line B1-B1' of FIG. 2 of the modification.
Figure 15:
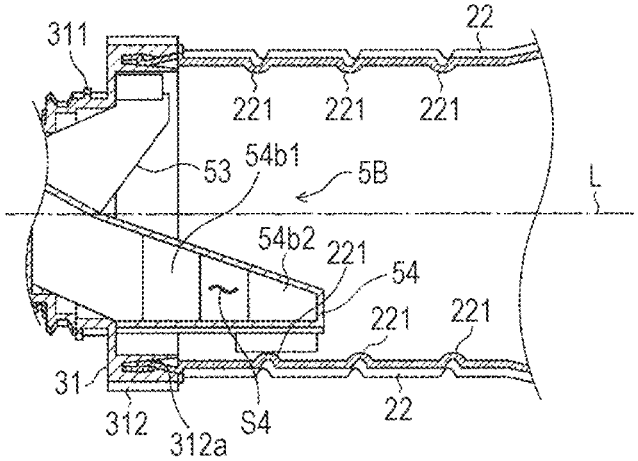
FIG. 15 is a cross-sectional view illustrating the state cut along the line B2-B2' of FIG. 2 of the modification.
Figure 16:
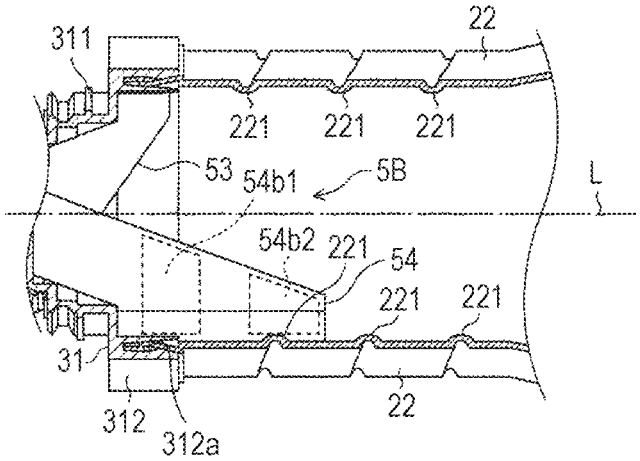
FIG. 16 is a cross-sectional view illustrating the state cut along the line B3-B3' of FIG. 2 of the modification.
Figure 17:
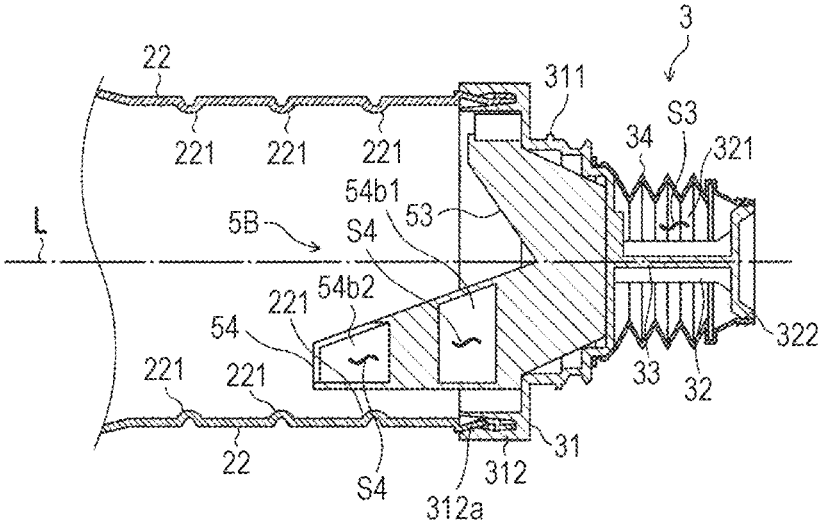
FIG. 17 is a cross-sectional view illustrating the state cut along the line C1-C1' of FIG. 2 of the modification.
Figure 18:
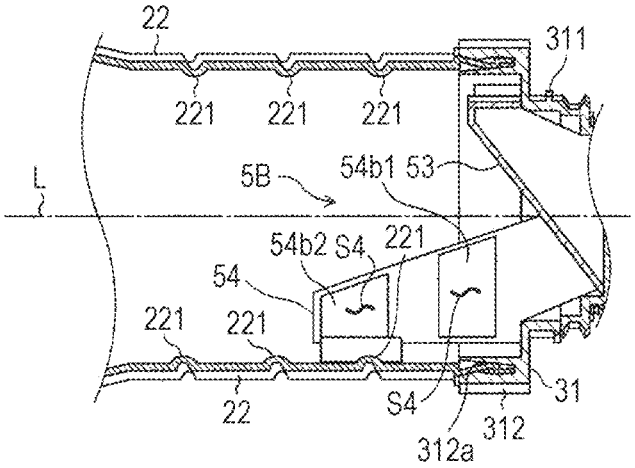
FIG. 18 is a cross-sectional view illustrating the state cut along the line C2-C2' of FIG. 2 of the modification.
Figure 19:
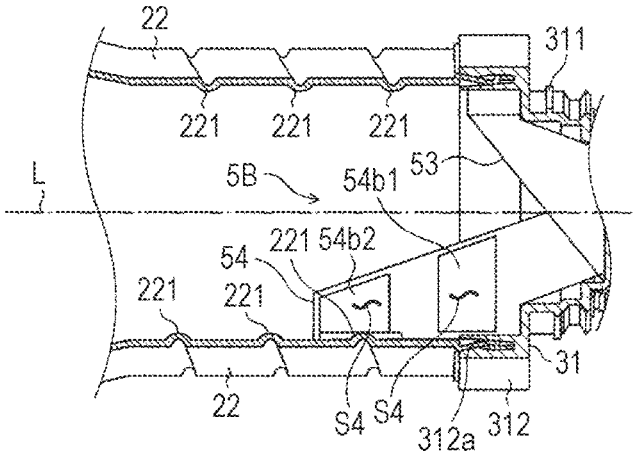
FIG. 19 is a cross-sectional view illustrating the state cut along the line C3-C3' of FIG. 2 of the modification.
Figure 20:
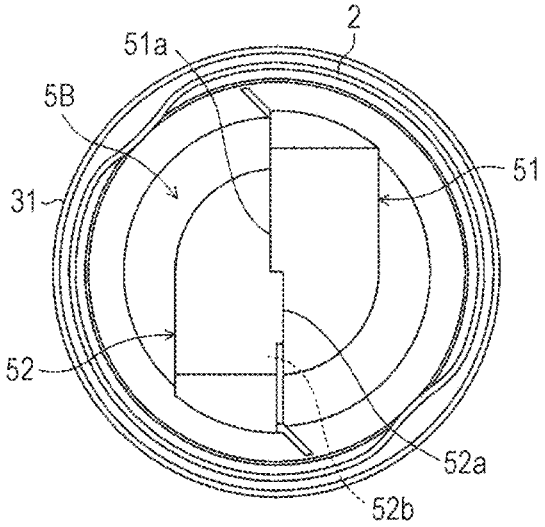
FIG. 20 is a cross-sectional view illustrating the state cut along the line A-A' of FIG. 2 of the modification.

FIG. 13A and FIG. 13B are perspective views each illustrating a modification of the appearance of the discharge member 3 as viewed from the container rear end side. FIG. 14 is a cross-sectional view illustrating the state cut along the line B1-B1' of FIG. 2 of the modification. FIG. 15 is a cross-sectional view illustrating the state cut along the line B2-B2' of FIG. 2 of the modification. FIG. 16 is a cross-sectional view illustrating the state cut along the line B3-B3' of FIG. 2 of the modification. FIG. 17 is a cross-sectional view illustrating the state cut along the line C1-C1' of FIG. 2 of the modification. FIG. 18 is a cross-sectional view illustrating the state cut along the line C2-C2' of FIG. 2 of the modification. FIG. 19 is a cross-sectional view illustrating the state cut along the line C3-C3' of FIG. 2 of the modification. FIG. 20 is a cross-sectional view illustrating the state cut along the line A-A' of FIG. 2 of the modification.

In the present embodiment, as illustrated in FIG. 5A to FIG. 12, the two openings 51*b* and 52*b* are provided separately in the first scooping-up member 51 and the second scooping-up member 52, respectively; however, both openings may be provided on one side. For example, instead of the scooping-up portion 5, a scooping-up portion 5B is provided as illustrated in FIG. 13A to FIG. 20.

The scooping-up portion 5B includes a first scooping-up member 53 and a second scooping-up member 54. The positional relationship between the first scooping-up member 53 and the second scooping-up member 54 is the same as the positional relationship between the first scooping-up member 51 and the second scooping-up member 52. A facing wall 54*a* of the second scooping-up member 54 includes an opening 54*b*2 at the same position as that of the opening 52*b* of the facing wall 52*a* of the second scooping-up member 52. A facing wall 53*a* of the first scooping-up member 53 includes no opening corresponding to the opening 51*b*, but instead, the facing wall 54*a* is provided with the opening 54*b*1.

When the developer is conveyed to the vicinity of the scooping-up portion 5B of the discharge member 3, the developer is scooped up by the facing wall 53*a* and the facing wall 54*a*. If there are not the opening 54*b*1 nor the opening 54*b*2, the developer is stopped by the scooping-up portion 5B, and is not conveyed further to the container tip side. However, since there are the opening 54*b*1 and the opening 54*b*2, a part of the developer enters a space S4 from the opening 54*b*1 or the opening 54*b*2. Then, the developer is conveyed to the space S3 and discharged out of the developer storage container 1 from the discharge port 321.

Figure 21A:
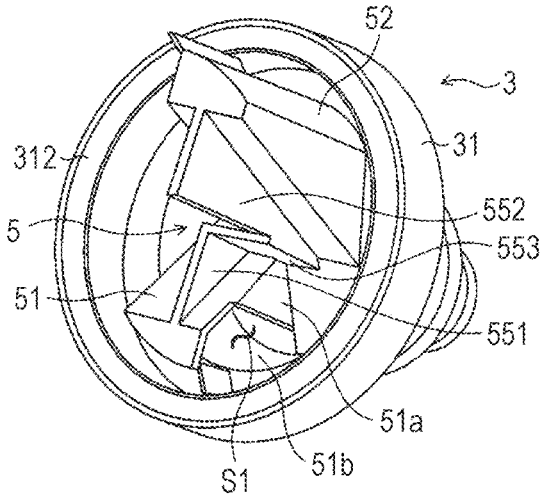
FIG. 21A and FIG. 21B are perspective views each illustrating a modification of the appearance of the discharge member as viewed from the container rear end side.
Figure 21B:
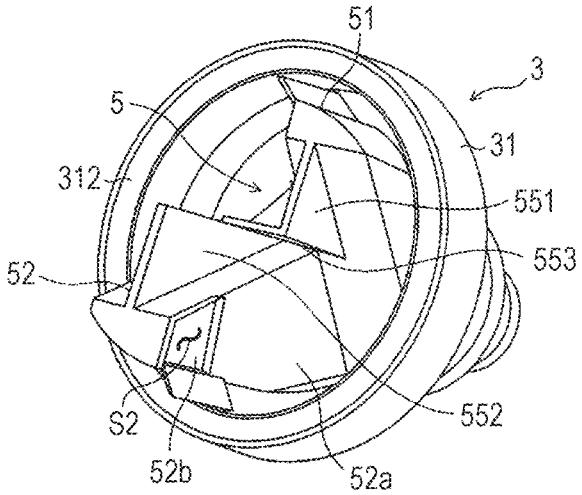
Figure 22:
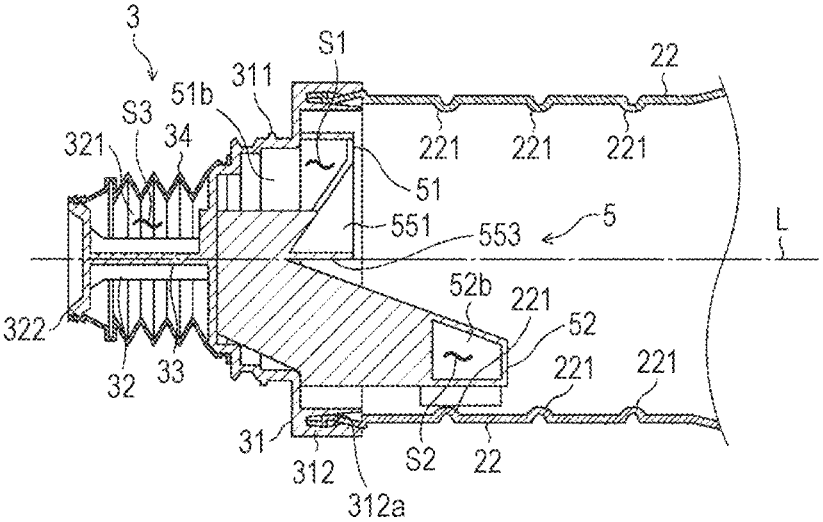
FIG. 22 is a cross-sectional view illustrating the state cut along the line B1-B1' of FIG. 2 of the modification.
Figure 23:
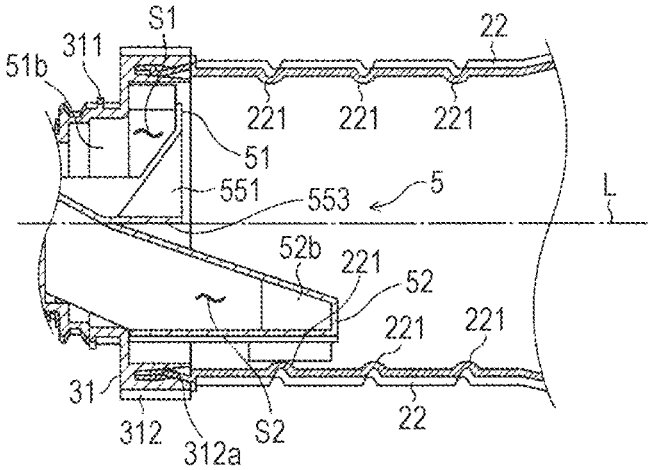
FIG. 23 is a cross-sectional view illustrating the state cut along the line B2-B2' of FIG. 2 of the modification.
Figure 24:
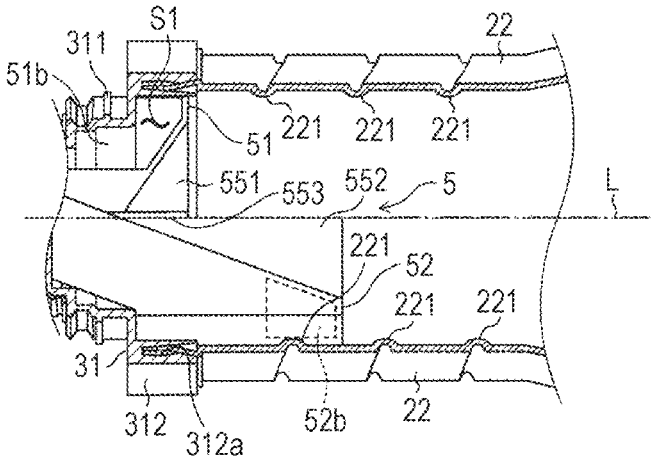
FIG. 24 is a cross-sectional view illustrating the state cut along the line B3-B3' of FIG. 2 of the modification.
Figure 25:
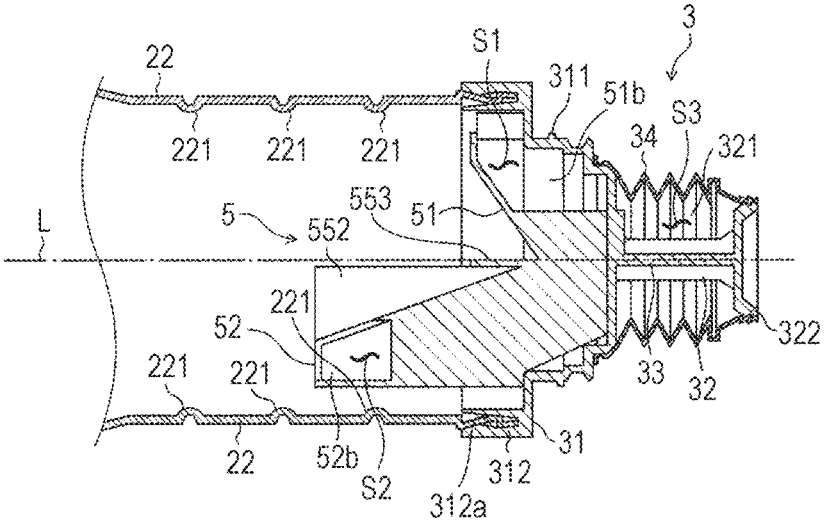
FIG. 25 is a cross-sectional view illustrating the state cut along the line C1-C1' of FIG. 2 of the modification.
Figure 26:
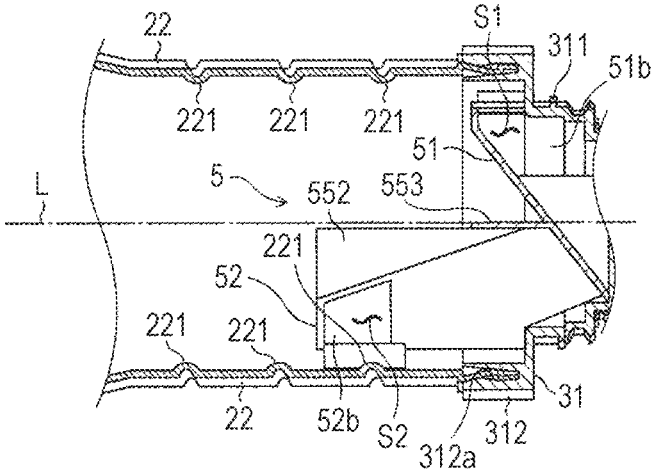
FIG. 26 is a cross-sectional view illustrating the state cut along the line C2-C2' of FIG. 2 of the modification.
Figure 27:
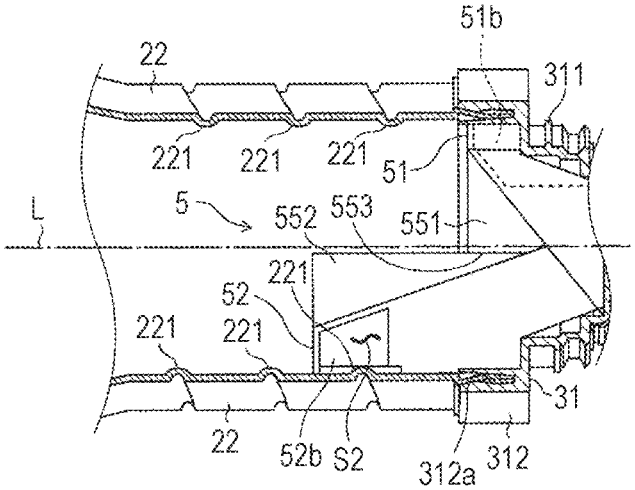
FIG. 27 is a cross-sectional view illustrating the state cut along the line C3-C3' of FIG. 2 of the modification.
Figure 28:
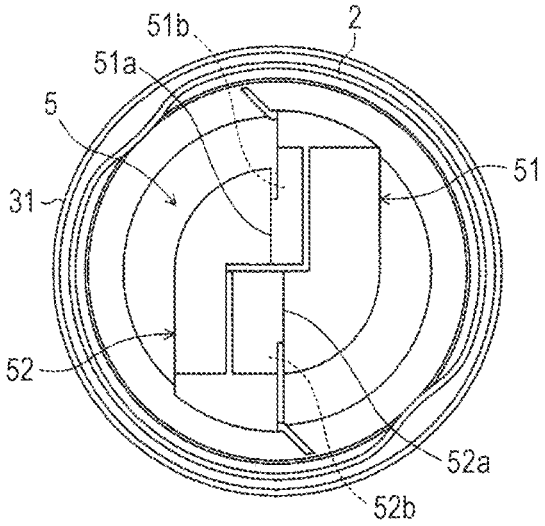
FIG. 28 is a cross-sectional view illustrating the state cut along the line A-A' of FIG. 2 of the modification.

FIG. 21A and FIG. 21B are perspective views each illustrating a modification of the appearance of the discharge member 3 as viewed from the container rear end side. FIG. 22 is a cross-sectional view illustrating the state cut along the line B1-B1' of FIG. 2 of the modification. FIG. 23 is a cross-sectional view illustrating the state cut along the line B2-B2' of FIG. 2 of the modification. FIG. 24 is a cross-sectional view illustrating the state cut along the line B3-B3' of FIG. 2 of the modification. FIG. 25 is a cross-sectional view illustrating the state cut along the line C1-C1' of FIG. 2 of the modification. FIG. 26 is a cross-sectional view illustrating the state cut along the line C2-C2' of FIG. 2 of the modification. FIG. 27 is a cross-sectional view illustrating the state cut along the line C3-C3' of FIG. 2 of the modification. FIG. 28 is a cross-sectional view illustrating the state cut along the line A-A' of FIG. 2 of the modification.

Alternatively, as illustrated in FIG. 21A to FIG. 28, a blade member 551 may be provided on the first scooping-up member 51 of the scooping-up portion 5, a blade member 552 may be provided on the second scooping-up member 52, and a partition plate 553 may be provided between the blade member 551 and the blade member 552. As a result, the amount of the developer can be increased that is stirred and scooped up.

Figure 29A:
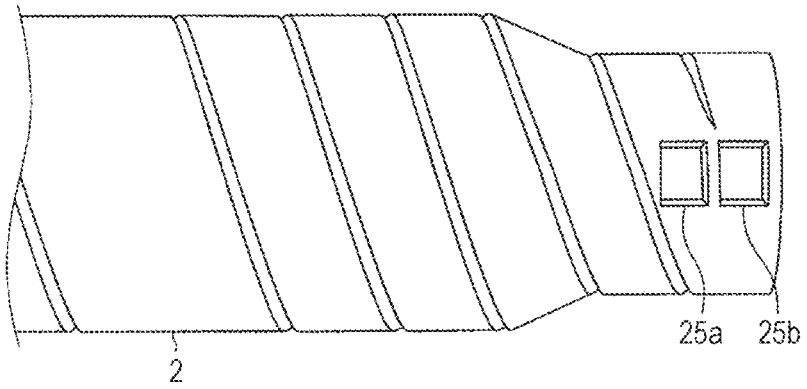
FIG. 29A and FIG. 29B are diagrams each illustrating a modification of a container body.
Figure 29B:
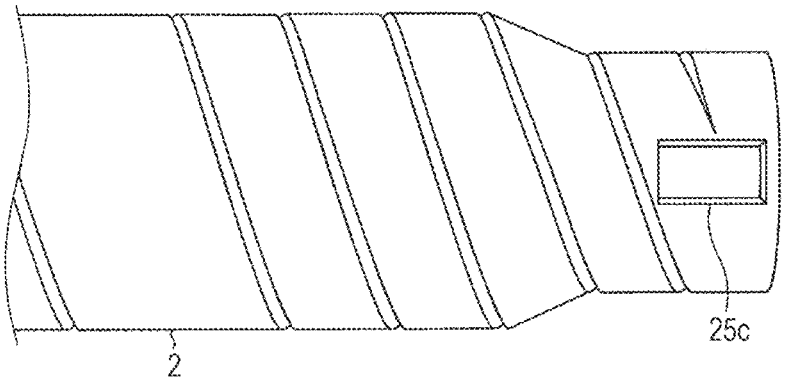

FIG. 29A and FIG. 29B are diagrams each illustrating a modification of the container body 2. In the case of a developer storage container 1B that does not include the discharge member 3 nor the cap 4, it is sufficient that a plurality of discharge ports is provided at respective different positions in the conveyance direction on the container body 2. For example, as illustrated in FIG. 29A, discharge ports 25*a* and 25*b* may be provided. Alternatively, as illustrated in FIG. 29B, a discharge port 25*c* may be provided that is long in the conveyance direction.

Moreover, the configuration of the whole or each portion of the developer storage container 1 can be appropriately changed in accordance with the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developer storage container comprising:

a container body that stores a developer; and a discharge member that suppresses an amount of the developer to be discharged from the container body, wherein the container body includes a first opening on a downstream side in a conveyance direction in which the developer is conveyed, and includes a first side wall whose cross section perpendicular to the conveyance direction is round, the first side wall includes on an inner surface a protrusion that continuously or intermittently continues to the downstream side spirally in a specific winding direction, the discharge member is provided at the first opening to close the first opening, and includes a discharge port that discharges the developer on the downstream side, and includes a suppressor that closes a space connecting to the discharge port on an upstream side in the conveyance direction from the discharge port, and includes a second side wall that is continuous to surround the suppressor along the conveyance direction, the suppressor includes a plurality of scooping-up members, each of the plurality of scooping-up members includes a scooping-up surface that scoops up the developer, and a plurality of second openings connecting to the space is provided on the scooping-up surface of any of the plurality of scooping-up members at respective positions different from each other in the conveyance direction.

2. The developer storage container according to claim 1, wherein the plurality of second openings is provided separately in the respective plurality of scooping-up members.

3. The developer storage container according to claim 1, wherein the plurality of second openings is all provided in one of the plurality of scooping-up members.

4. The developer storage container according to claim 1, wherein the plurality of scooping-up members is two scooping-up members, and the scooping-up surfaces of the respective two scooping-up members are parallel to each other.

5. The developer storage container according to claim 4, wherein the scooping-up surface of each of the two scooping-up members has a width wider on the downstream side than on the upstream side.

6. The developer storage container according to claim 5, wherein the suppressor includes, between the two scooping-up members, a stirring member that stirs the developer.

7. The developer storage container according to claim 1, wherein the first side wall has a uniform radius of the cross section in at least in a vicinity surrounding the suppressor.

* * * * *